US008497644B2

(12) United States Patent
Eom et al.

(10) Patent No.: US 8,497,644 B2
(45) Date of Patent: Jul. 30, 2013

(54) REFRIGERATOR AND METHOD FOR CONTROLLING THE SAME

(75) Inventors: Yong Hwan Eom, Seoul (KR); Myung Keun Yoo, Seoul (KR); Hyoun Jeong Shin, Seoul (KR); Ok Sun Yu, Seoul (KR); Young Jin Kim, Seoul (KR); Seung Do Han, Seoul (KR)

(73) Assignee: LG Electronics Inc., Seoul (KR)

( * ) Notice: Subject to any disclaimer, the term of this patent is extended or adjusted under 35 U.S.C. 154(b) by 694 days.

(21) Appl. No.: 12/726,643

(22) Filed: Mar. 18, 2010

(65) Prior Publication Data

US 2010/0236281 A1 Sep. 23, 2010

(30) Foreign Application Priority Data

Mar. 20, 2009 (KR) ..... 10-2009-0024206

(51) Int. Cl.
*H02P 7/00* (2006.01)

(52) U.S. Cl.
USPC ..... 318/266; 318/264; 318/466; 318/468

(58) Field of Classification Search
USPC .... 318/264, 265, 266, 466, 467, 468; 337/41, 337/42, 72, 85; 361/23, 24, 25, 27
See application file for complete search history.

(56) References Cited

U.S. PATENT DOCUMENTS

| | | | |
|---|---|---|---|
| 2,873,159 | A | 2/1959 | Otto |
| 4,829,429 | A | 5/1989 | Komai et al. |
| 5,280,227 | A | 1/1994 | Bashark |
| 5,392,951 | A | 2/1995 | Gardner et al. |
| 5,445,294 | A | 8/1995 | Gardner et al. |
| 5,775,786 | A | 7/1998 | Liebertz |
| 5,899,083 | A | 5/1999 | Peterson et al. |
| 5,940,306 | A | 8/1999 | Gardner et al. |
| 6,130,621 | A | 10/2000 | Weiss |
| 6,445,152 | B1 | 9/2002 | Calamatas |
| 6,751,909 | B2 | 6/2004 | Ranaudo |
| 6,779,855 | B2 | 8/2004 | Hoffman |
| 7,006,876 | B2 | 2/2006 | Ross |
| 7,063,398 | B2 | 6/2006 | Hoffman |
| 7,075,446 | B2 | 7/2006 | Schondelmaier et al. |
| 7,121,099 | B2 | 10/2006 | Shimizu et al. |
| 7,197,888 | B2 | 4/2007 | LeClear et al. |

(Continued)

FOREIGN PATENT DOCUMENTS

| | | |
|---|---|---|
| CN | 2406551 | 11/2000 |
| CN | 1468569 | 1/2004 |

(Continued)

OTHER PUBLICATIONS

U.S. Office Action issued in U.S. Appl. No. 12/510,372 dated Nov. 30, 2011.

(Continued)

*Primary Examiner* — Bentsu Ro
*Assistant Examiner* — Thai Dinh
(74) *Attorney, Agent, or Firm* — Ked & Associates LLP

(57) ABSTRACT

A refrigerator and a method for controlling the same are provided. With the refrigerator and the method for controlling the refrigerator, a receiving box may be automatically drawn in and out together with a door when a user operates an input device that inputs door drawing in and out instructions, thereby increasing use convenience of children and older people.

22 Claims, 8 Drawing Sheets

U.S. PATENT DOCUMENTS

| | | | | |
|---|---|---|---|---|
| 7,282,884 | B2 | 10/2007 | Huber et al. | |
| 7,293,845 | B2 | 11/2007 | Hoffman | |
| 7,307,395 | B2 | 12/2007 | Bouamra et al. | |
| 7,407,210 | B2 | 8/2008 | Arbaugh et al. | |
| 7,430,937 | B2 | 10/2008 | Rotter et al. | |
| 7,484,817 | B2 | 2/2009 | Hoffman et al. | |
| 7,533,947 | B2 | 5/2009 | Kim et al. | |
| 7,587,907 | B2 | 9/2009 | Kim et al. | |
| 7,594,707 | B2 | 9/2009 | Kunkle et al. | |
| 7,602,135 | B2 | 10/2009 | Huber et al. | |
| 7,633,258 | B2 | 12/2009 | Huber et al. | |
| 7,641,707 | B2 | 1/2010 | Kang et al. | |
| 7,688,015 | B2 | 3/2010 | Wenzel et al. | |
| 7,731,314 | B2 | 6/2010 | Kim | |
| 7,784,888 | B2 | 8/2010 | Oh et al. | |
| 7,800,477 | B1 * | 9/2010 | Komer | 337/102 |
| 7,802,515 | B2 | 9/2010 | Suetsugu | |
| 7,812,561 | B2 | 10/2010 | Hagen et al. | |
| 7,859,203 | B2 | 12/2010 | Miyashita | |
| 7,868,578 | B2 | 1/2011 | Scheffknecht et al. | |
| 7,928,684 | B2 | 4/2011 | Hauer | |
| 8,067,915 | B2 * | 11/2011 | Hooker et al. | 318/466 |
| 8,074,468 | B2 | 12/2011 | Yoo et al. | |
| 8,134,313 | B2 | 3/2012 | Zipp | |
| 8,141,968 | B2 | 3/2012 | Velarde et al. | |
| 8,169,175 | B2 * | 5/2012 | Yu et al. | 318/466 |
| 8,169,176 | B2 | 5/2012 | Yu et al. | |
| 8,217,613 | B2 | 7/2012 | Yoo et al. | |
| 8,274,251 | B2 | 9/2012 | Yoo et al. | |
| 8,282,177 | B1 | 10/2012 | Rotter | |
| 2001/0009360 | A1 | 7/2001 | Jin | |
| 2002/0171335 | A1 | 11/2002 | Held | |
| 2003/0078710 | A1 | 4/2003 | Li | |
| 2004/0035129 | A1 | 2/2004 | Kaiser | |
| 2004/0100165 | A1 | 5/2004 | Hoffman | |
| 2004/0100166 | A1 | 5/2004 | Hoffman | |
| 2004/0100169 | A1 | 5/2004 | Huber et al. | |
| 2004/0138843 | A1 | 7/2004 | Bouamra et al. | |
| 2005/0128660 | A1 * | 6/2005 | Dlugosz et al. | 361/23 |
| 2005/0284113 | A1 | 12/2005 | Jang et al. | |
| 2006/0042301 | A1 | 3/2006 | Oh et al. | |
| 2006/0061245 | A1 | 3/2006 | Huber et al. | |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0104756 | A1 | 5/2006 | Kim et al. | |
| 2006/0196198 | A1 | 9/2006 | Kim et al. | |
| 2006/0207283 | A1 | 9/2006 | Kim et al. | |
| 2006/0226749 | A1 | 10/2006 | Kim | |
| 2006/0242988 | A1 | 11/2006 | Kim et al. | |
| 2006/0261775 | A1 | 11/2006 | Huber et al. | |
| 2006/0267461 | A1 | 11/2006 | Hoffman | |
| 2007/0013274 | A1 | 1/2007 | Hoffman | |
| 2007/0170828 | A1 | 7/2007 | Hoshide et al. | |
| 2007/0256036 | A1 | 11/2007 | Johnson et al. | |
| 2008/0018215 | A1 | 1/2008 | Carden et al. | |
| 2008/0110092 | A1 | 5/2008 | Takahashi | |
| 2008/0116777 | A1 | 5/2008 | Kappler et al. | |
| 2008/0163639 | A1 | 7/2008 | Hwang | |
| 2008/0302114 | A1 | 12/2008 | Kelly et al. | |
| 2008/0314067 | A1 | 12/2008 | Lee | |
| 2009/0026906 | A1 | 1/2009 | Kim | |
| 2009/0091223 | A1 | 4/2009 | Hagen et al. | |
| 2009/0102338 | A1 | 4/2009 | Wenzel et al. | |
| 2009/0160297 | A1 * | 6/2009 | Anikhindi et al. | 312/319.7 |
| 2009/0199484 | A1 | 8/2009 | Zipp | |
| 2009/0206715 | A1 | 8/2009 | Scheffknecht et al. | |
| 2009/0243454 | A1 | 10/2009 | Yoo et al. | |
| 2009/0248205 | A1 | 10/2009 | Yu et al. | |
| 2009/0248207 | A1 | 10/2009 | Yoo et al. | |
| 2009/0254221 | A1 | 10/2009 | Kang | |
| 2009/0261698 | A1 | 10/2009 | Velarde et al. | |

FOREIGN PATENT DOCUMENTS

| | | |
|---|---|---|
| CN | 101358792 A | 2/2009 |
| EP | 0779484 | 6/1997 |
| JP | 02-103388 | 4/1990 |
| JP | 02-106686 | 4/1990 |
| JP | 02-136686 | 5/1990 |
| JP | 02-146487 | 6/1990 |
| JP | 03-045820 | 2/1991 |
| JP | 07-174459 | 7/1995 |
| JP | 11-094455 | 4/1999 |
| JP | 2005-326044 | 11/2005 |
| JP | 2006-023039 | 1/2006 |
| JP | 2006-046741 | 2/2006 |
| JP | 2006-046748 | 2/2006 |
| JP | 2006-145055 | 6/2006 |
| JP | 2006-250485 | 9/2006 |
| JP | 2007-017018 | 1/2007 |
| JP | 2007-093208 | 4/2007 |
| JP | 2007-132605 | 5/2007 |
| JP | 2008-8550 | 1/2008 |
| JP | 2008-196744 | 8/2008 |
| JP | 2008-196752 | 8/2008 |
| JP | 2009-036433 | 2/2009 |
| KR | 1999-003684 | 1/1999 |
| KR | 20-0301747 | 1/2003 |
| KR | 20-0334077 | 11/2003 |
| KR | 10-2006-0025806 | 3/2006 |
| KR | 10-0634366 | 10/2006 |
| KR | 10-2007-008046 | 1/2008 |
| WO | WO 2006/126584 | 11/2006 |
| WO | WO 2007/009783 | 1/2007 |

OTHER PUBLICATIONS

International Search Report issued in PCT Application No. PCT/KR2008/001694 dated Dec. 3, 2008.

International Search Report issued in PCT Application No. PCT/KR2008/001696 dated Dec. 3, 2008.

International Search Report issued in PCT Application No. PCT/KR2008/001697 dated Dec. 3, 2008.

International Search Report issued in PCT Application No. PCT/KR2008/001695 dated Dec. 8, 2008.

International Search Report issued in PCT Application No. PCT/KR2010/001497 dated Oct. 22, 2010.

International Search Report issued in PCT Application No. PCT/KR2010/001496 dated Oct. 22, 2010.

International Search Report issued in PCT Application No. PCT/KR2010/001495 dated Oct. 25, 2010.

International Search Report issued in PCT Application No. PCT/KR2010/001409 dated Oct. 25, 2010.

International Search Report issued in PCT Application No. PCT/KR2010/001410 dated Oct. 25, 2010.

U.S. Office Action issued in U.S. Appl. No. 12/390,523 dated Feb. 7, 2012.

U.S. Office Action issued in U.S. Appl. No. 12/390,527 dated Feb. 14, 2012.

U.S. Office Action issued in U.S. Appl. No. 12/724,558 dated Mar. 14, 2012.

U.S. Office Action dated Apr. 22, 2011 issued in U.S. Appl. No. 12/390,520.

U.S. Notice of Allowance issued in U.S. Appl. No. 12/390,523 dated Jun. 27, 2012.

U.S. Office Action issued in U.S. Appl. No. 12/345,946 dated May 19, 2011.

U.S. Office Action issued in U.S. Appl. No. 12/345,984 dated May 23, 2011.

U.S. Office Action issued in U.S. Appl. No. 12/724,558 dated Aug. 13, 2012.

U.S. Office Action issued in U.S. Appl. No. 12/390,524 dated Aug. 25, 2011.

U.S. Office Action issued in U.S. Appl. No. 12/345,946 dated Sep. 26, 2011.

U.S. Office Action issued in U.S. Appl. No. 12/345,984 dated Sep. 26, 2011.

U.S. Office Action issued in U.S. Appl. No. 12/724,606 dated Sep. 13, 2012.

Chinese Office Action dated Sep. 26, 2011.

Chinese Office Action issued in CN Application No. 201080012399.5 dated Oct. 24, 2012.
U.S. Notice of Allowance issued in U.S. Appl. No. 12/724,648 dated Nov. 9, 2012.
U.S. Office Action issued in U.S. Appl. No. 12/724,571 dated Nov. 16, 2012.
U.S. Office Action issued in U.S. Appl. No. 12/724,606 dated Jan. 11, 2013.
Chinese Office Action dated Dec. 12, 2012.
U.S. Office Action issued in U.S. Appl. No. 12/724,571 dated Mar. 5, 2013.
Notice of Allowance issued in U.S. Appl. No. 12/724,571 dated Mar. 7, 2013.

* cited by examiner

REFRIGERATOR AND METHOD FOR CONTROLLING THE SAME

The present application claims priority under 35 U.S.C. 119 and 35 U.S.C. 365 to Korean Patent Application No. 10-2009-0024206, filed in Korea on Mar. 20, 2009, which is hereby incorporated by reference in its entirety.

BACKGROUND

1. Field

A refrigerator and a method for controlling the same are disclosed herein.

2. Background

Refrigerators and methods for controlling the same are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
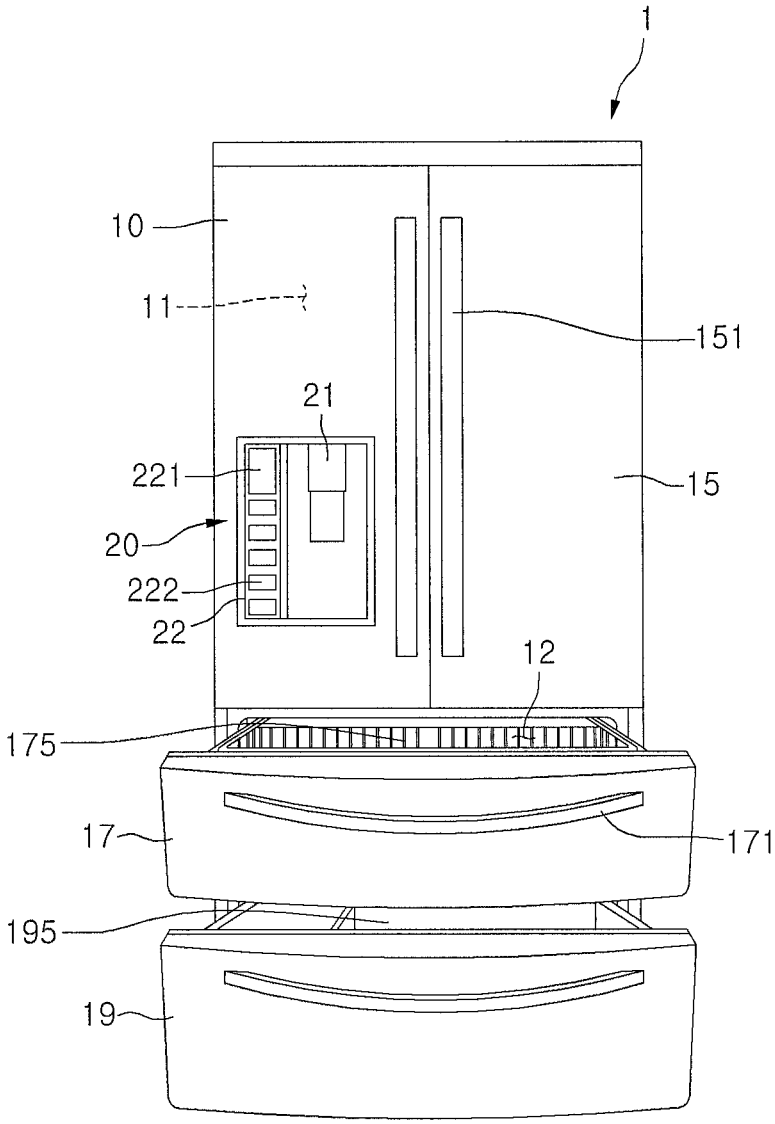
FIG. 1 is a front view of a refrigerator according to an embodiment.

In the following detailed description of the embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, embodiments will be described with reference to the accompanying drawings.

Generally, a refrigerator is electric home appliance that keeps food in a refrigerated or frozen state. More specifically, refrigerators may be classified as, for example, a top mount type refrigerator, a bottom freezer type refrigerator, and a side by side type refrigerator depending on locations of a freezing chamber and a refrigerating chamber.

In the bottom freezer type refrigerator, a freezing chamber may be disposed below a refrigerating chamber. A refrigerating chamber door that opens and closes the refrigerating chamber may be rotatably mounted at an edge of one side of a refrigerator main body, and a freezing chamber door that opens and closes the freezing chamber may be disposed in such a way that it is drawn in and out together with a receiving box in forward and backward directions.

The freezing chamber may be disposed at a lower side of the refrigerator, and thus, when a user opens the freezing chamber, he/she must bend his/her waist to pull the door of the freezing chamber forward. As the user must put forth a higher strength than when pulling the freezing chamber door in a state in which the user stands up straight, which is inconvenient.

To solve this inconvenience, structures for easily opening the freezing chamber door have appeared. For example, there has been proposed an automatically opening structure to move the freezing chamber door a predetermined distance from a front surface of the main body by sensing motion of a user to hold and pull a door handle to open the freezing chamber door.

As another method, there has been proposed a structure including a motor fixedly mounted on a bottom surface of the freezing chamber, such that the freezing chamber door is drawn out by a driving force of the motor. In more detail, the motor may be fixedly mounted to the bottom surface of the refrigerating chamber and a rotation member, such as a gear, may be connected to a rotational shaft of the motor. A bottom surface of the receiving box may contact the rotational member, such that the receiving box may move forward and backward depending on the rotation of the rotational member.

However, such a receiving box type refrigerator has the following drawbacks. First, in the case of a refrigerator without a structure for automatically drawing out the receiving box, a user must hold a handle that protrudes from a front surface of the receiving box, concentrate his/her strength on the handle, and pull the handle with all his/her strength. However, a rear surface of the receiving box of the refrigerator may be mounted with a sealing member, such as a gasket, to prevent leakage of cool air and an inside of the sealing member may be provided with a close adhesion member, such as a magnet. Therefore, when the receiving box is closed, it maintains a close adhered state to the main body of the refrigerator by magnetic force. In this state, a user must put forth a larger strength than the magnetic force to pull and draw out the receiving box. In addition, when the receiving box is installed on a lower side of the refrigerator, the user's body may be overstrained since the receiving box must be pulled in a state in which the user bends his/her waist. In other words, there may occur a problem in that it is slightly difficult for older people, children, and women to open the receiving box.

Further, since the handle for pulling the receiving box may protrude from a front surface of the receiving box, it is disadvantageous that a volume of packing materials in the refrigerator is increased. When the refrigerator is installed in a room, because a space corresponding to the protruded portion of the handle is needed, it is disadvantageous that space utilization is degraded.

Moreover, since the handle may protrude from the front surface of the refrigerator, there may be a risk that a user may crash against the protruded portion during his/her movement, or children may crash against the protruded portion while they are running around a room.

The foregoing refrigerator having a receiving box separating device that pushes the receiving box by a predetermined distance to separate it from the main body of the refrigerator also has the following drawbacks.

First, the refrigerator having a device that separates the receiving box from the main body must also have a handle. In other words, because the refrigerator has a structure that separates the receiving box from the main body by sensing when the user holds the handle and pulls the receiving box, the handle is an essential component. As a result, the refrigerator still has the above discussed problems.

Second, since time consumed to sense when the user holds the handle and draws out the receiving box by a controller and drive the receiving box separating device is too long, in comparison to time consumed to hold the handle and drawing out the receiving box by the user, efficiency is degraded. In other words, a reaction speed of the receiving box separating device according to the operation of drawing out the receiving box is slow, such that the user cannot substantially recognize the convenience.

Third, since the receiving box separating device simply pushes the receiving box by a predetermined distance to separate the receiving box from the main body of the refrigerator, it is disadvantageous that the user must still pull the handle. In this case, when a weight of food received in the receiving box is heavy, there is a problem in that it is difficult to draw out the receiving box.

In addition, a refrigerator including a motor fixedly mounted on a bottom surface of the main body of the refrigerator to draw out the receiving box has the following problems.

First, because a driving motor and a gear assembly must be mounted on the bottom surface of the refrigerating chamber or the freezing chamber, it is disadvantageous that a volume of the refrigerator is reduced accordingly.

Second, even when the driving motor and the gear assembly are mounted to be depressed to a lower side from an inner case of the refrigerator, there is a problem in that a heat shield loss of the main body of the refrigerator may occur. In other words, the main body of the refrigerator may include an outer case, an inner case, and a heat shield layer mounted therebetween. With this structure, when the inner case is depressed to mount the motor, the heat shield layer may become thin accordingly, such that there occurs a problem in that the heat shield effect between an inside of the refrigerator and an interior of a room may be degraded.

Third, when the motor and the gear assembly are fixedly mounted on the bottom surface of the inside of the refrigerator, a rack engaging with the gear must be lengthily mounted on the bottom surface of the receiving box extending in forward and backward directions. A maximum length of the rack may correspond to an entire length of the bottom surface of the receiving box. A machine room in which a compressor and a condenser are received may be mounted on a rear end of lower side of the refrigerator. Therefore, in the bottom freezer type refrigerator, the rear surface of the receiving box of the freezing chamber may be formed to be inclined forward. In other words, the entire length of lower end of the receiving box of the freezing chamber may be shorter than an entire length of upper end of the receiving box of the freezing chamber.

If the receiving box drawing out structure is mounted in the receiving box of the freezing chamber of the bottom freezer type refrigerator, the rack must be mounted on the bottom surface of the receiving box of the freezing chamber. In this case, when the receiving box of the freezing chamber is maximally drawn out, it is disadvantageous that a rear end of upper side of the receiving box of the freezing chamber is not completely drawn out from the freezing chamber.

Fourth, when the plurality of receiving boxes of the refrigerator are mounted in an upward and downward direction, the separate motor and gear assembly to draw out the receiving box of the upper side must be mounted. Thus, it is disadvantageous that separate barriers must be mounted on the receiving box of the upper side and the receiving box of the lower side.

Fifth, the refrigerator having the structure that the motor is fixedly mounted on the bottom surface of the main body of the refrigerator to draw out the receiving box does not include a function of sensing the drawing out speed of the receiving box during the process of drawing out the receiving box and controlling it. In other words, the refrigerator according to the related art simply senses whether the receiving box is completely dawn out and completely closed by mounting lead switches on front end and ends of the rack installed on the bottom surface of the refrigerator. Therefore, it is disadvantageous that the refrigerator cannot sense whether the receiving box is drawn out at a normal speed, whether the operation of drawing out the receiving box is hindered by an obstacle, and whether the receiving box is drawn out at a set speed regardless of a weight of food received in the receiving box.

More specifically, if the drawing-out and the drawing-in of the receiving box is hindered by an obstacle, the rotational shaft is not rotated even though power is continuously supplied to the motor so that it may cause a problem that the motor is overheated. In addition, the power is still supplied even though the receiving box cannot be moved so that it may cause a disadvantage that power consumption is increased.

FIG. 1 is a front view of a refrigerator according to an embodiment. Referring to FIG. 1, a refrigerator 1 according to an embodiment may include a main body 10. An inside of the main body 10 may be provided with a storage space that stores food at a low temperature.

The storage space may include at least one of a refrigerating chamber 11 that stores food at low temperature and a freezing chamber 12 that freezes and stores food. In this embodiment, the refrigerator 10 including the refrigerating chamber 11 disposed on an upper side of the main body 10 and the freezing chamber 12 disposed on a lower side of the main body 10 will be described as an example.

The refrigerating chamber 11 may be selectively opened and closed by a refrigerating chamber door 15. The refrigerating chamber door 15 may be rotatably coupled to a front surface of the main body 10 and a front surface of the refrigerating chamber door 15 may be formed with a handle 151, which may be held by a user.

The freezing chamber 12 may be selectively opened and closed by freezing chamber doors 17 and 19. The freezing chamber 12 may be partitioned into two spaces according to user demand, which may be independently used and operated. In this embodiment, the refrigerating doors 17 and 19 may include the upper door 17 that opens and closes an upper space of the freezing chamber 12 and the lower door 19 that opens and closes a lower space.

The upper door 17 may be formed to be slidably drawn in and out to open and close the upper space of the freezing chamber 12. On a rear side of the upper door 17, a receiving box 175 configured to receive food therein may be attached and detached to and from a slide assembly (30 of FIG. 2) that moves the upper door 17 forward and backward, or a rail connector 34 coupled to the slide assembly 30, such that the receiving box 175 is drawn in and out together with the upper door 17. Further, a front surface of the upper door 17 may be further formed with a handle 171, which may be held by a user to move the upper door 17.

The upper door 17 may be slidably drawn in and out manually by a user holding the handle 171 and pulling and pushing it, or may be slidably drawn in and out automatically by instruction of the user through a predetermined input device. The lower door 18 may be slidably moved like the upper door 17, making it possible to open and close the lower space of the freezing chamber 12. In addition, opening and closing the freezing chamber 12 by two doors is by way of example only, that is, the freezing chamber 12 may be opened and closed by one door.

One side of the refrigerating chamber door 15 may be provided with a dispenser 20. The dispenser 20 may include a dispensing device 21 that dispenses, for example, water or ice and an operation device 22 formed at one side of the dispensing unit 21. The operation device 22 may include a display device 221 that displays an operation state of the dispenser 20 or the refrigerator 1 and a plurality of buttons configured to control operations of the dispenser 20 or the refrigerator 1.

The operation device 22 may further include an input device 222 configured to receive input of a sliding drawing in and out instruction for the upper door 17. The input device 222 may be provided in various types or forms, such as, for example, a capacitance switch that uses a change in capacitance, a generally widely used tact switch, or a toggle switch, or may be provided as, for example, a user voice recognizing device, a sound recognizing device, or a light sensing device.

In addition, the input device 222 may be provided at the dispenser 20 or the operation device 22; however, embodiments are not limited thereto. The input device 222 may be independently provided at front or side surfaces of the doors 15, 17, and 19.

For example, the input device 222 may be provided at one side of a front surface of one of the doors that will be automatically opened, and may be a vibration sensor, such as a vibration sensing switch, that is operated to sense vibration transferred to the door. In other words, when a user applies a weak impact to the door using his or her foot in a state in which the user cannot use his/her hands, the vibration sensor may sense vibration transferred from the impact, such that the door may be slidably drawn in and out.

Moreover, the input device 222 may be provided as a single button configured to receive all of the drawing in and out instructions of the upper door 17. Alternatively, a button configured to receive the drawing out instruction and a button configured to receive the drawing in instruction may be independently provided. For example, in a case where the input device 222 is provided as a single button, the input device 222 may be configured so that when the button is pressed when the upper door 17 is drawn in, it is determined to be the drawing out instruction, and when the button is pressed when the upper door 17 is drawn out, it is determined to be the drawing in instruction. In this case, if the button is pressed during movement of the upper door 17 or the button is continuously pressed for a predetermined period of time, it may be determined to be a stop instruction. In other words, what instruction a user inputs may be determined by a pressing frequency and pressing time of the input device 222.

A machine room (not shown) partitioned from the storage space that contains components that generate cool air supplied to the storage space may be provided at one side of the main body 10. The machine room may include a compressor that compresses refrigerant at high temperature and high pressure, a condenser that condenses the refrigerant supplied from the compressor, and an expander that expands the refrigerant supplied from the condenser to lower the pressure. The refrigerant passing through the expander may be supplied to an evaporator provided at one side of the storage space, that exchanges heat with air circulating in the storage space. In other words, the air circulating in the storage space may transfer heat to the refrigerant passing through the evaporator and become cool air in a low temperature state.

Hereinafter, a detailed configuration of structure that slidably draws in and out the upper door 17 will be described with reference to the drawings.

Figure 2:
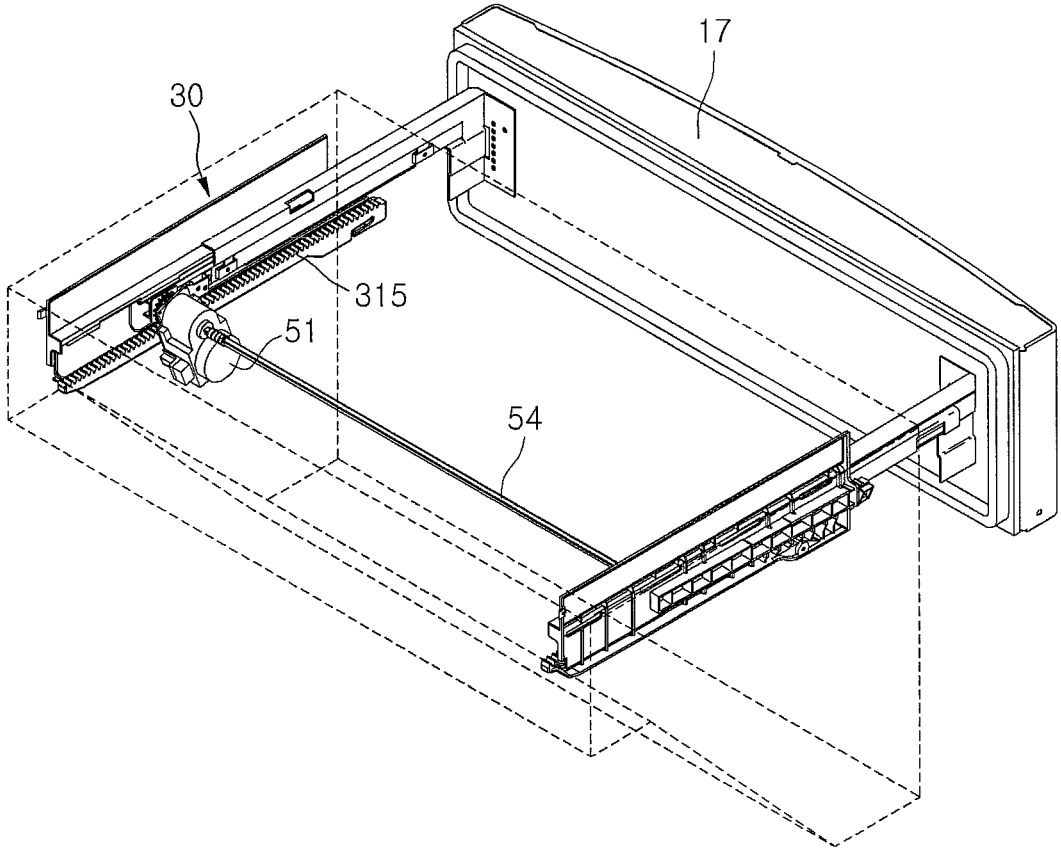
FIG. 2 is a front perspective view of a sliding assembly by which an upper door of the refrigerator of FIG. 1 may be drawn out.
Figure 3:
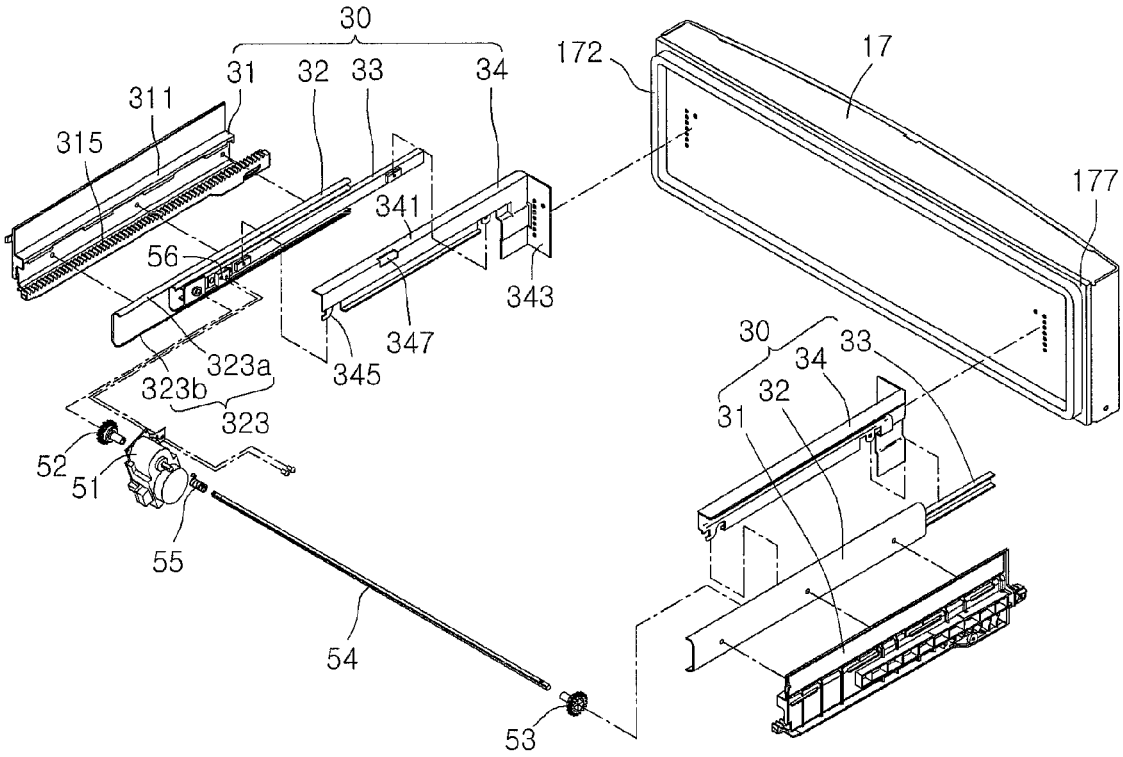
FIG. 3 is an exploded perspective view of the sliding assembly of FIG. 2.
Figure 4:
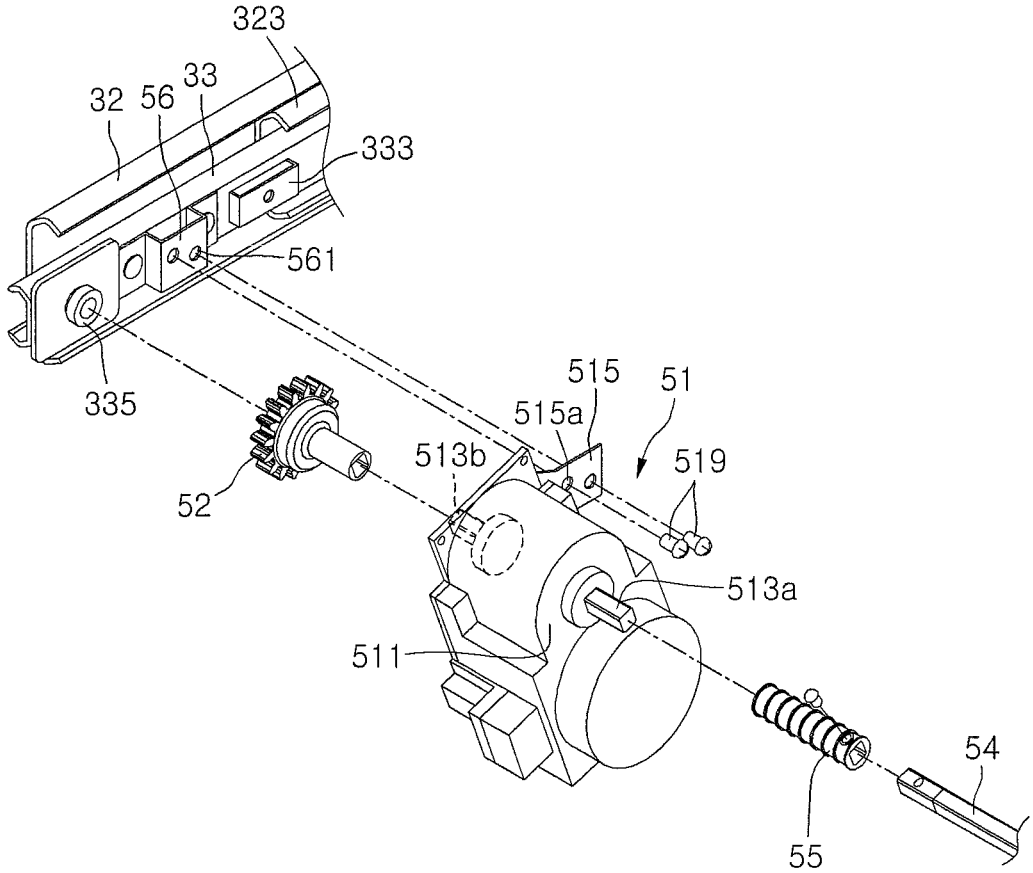
FIG. 4 is an exploded perspective view of a door driving assembly coupled to the slide assembly of FIG. 2.

FIG. 2 is a front perspective view of a sliding assembly by which an upper door of the refrigerator of FIG. 1 may be drawn out. FIG. 3 is an exploded perspective view of the sliding assembly of FIG. 2. FIG. 4 is an exploded perspective view of a door driving assembly coupled to the slide assembly of FIG. 12. Referring to FIGS. 2 to 4, the upper door 17 may be configured to connect to a slide assembly 30 and open and close the upper side space of the freezing chamber 12.

The slide assembly 30 may be fixed to a side or inner wall of the freezing chamber 12 and may include a rail connector 34, which may be fixed to the upper door 17. The upper door 17 may move forward and backward according to a sliding movement of the slide assembly 30. The receiving box 175 may be removably coupled to the slide assembly 30 or the rail connector 34. In this embodiment, the receiving box 175 is shown connected to the rail connector 34.

The slide assembly 30 may include a rail guide 31, which may be fixedly mounted on the side or inner wall of the freezing chamber 12, a fixing rail 32 coupled to the rail guide 31, and a moving rail 33 slidably coupled to the fixing rail 32. The moving rail 33 may be coupled to the rail connector 34, which may be coupled to a rear surface of the upper door 17.

The rail guide 31 may be provided at both side or inner walls of the freezing chamber 12, respectively, and may extend in a direction in which the upper door 17 is drawn in and out. In other words, the rail guide 31 may extend in front and rear directions of the refrigerator 1. The rail guide 31 may be firmly coupled to the side or inner wall of the freezing chamber 12 by, for example, a bolt or other type fastener, so that upper door 17 may be stably drawn in and out.

A rack 315 that guides movement of a pinion 52 to be described hereinbelow may be formed at a lower portion of the rail guide 31. The rack 315 may be formed to protrude by a predetermined length from the lower portion of the rail guide 31 so that the pinion 52 may be seated thereon. In addition, the rack 315 may be formed in a straight line so that a central portion of the pinion 52 may be moved in a straight line, and the rack 315 may extend from a rear end of the freezing chamber 17 to a front end thereof. In addition, an upper portion of the rail guide 31 may be curved toward an inside of the freezing chamber 12 to form a support 311 that supports a seating part 341 of the rail connector 34.

The fixing rail 32 may be coupled to a space between the rack 315 and the support 311. The fixing rail 32 may be provided with a guide 323 that guides sliding movement of the moving rail 33. The guide 323 may include an upper side guide **323*a* and a lower side guide 323*b* that are protrudedly formed spaced apart by an amount or distance corresponding to a width of the moving rail 33. The guides 323*a*, 323*b* may be curved and face each other and may extend a predetermined length so that the moving rail 33 is not separated therefrom during the sliding movement. In other words, the guides 323*a*, 323*b* may perform a role of holding upper and lower sides of the moving rail 33, respectively. In addition, the guide 323 may extend in parallel with the rack 315 so that the moving rail 33 may be smoothly moved linearly. In addition, the fixing rail 32 may be firmly coupled to the guide rail 31 by, for example, a bolt or other fixture, so that upper door 17** may be stably drawn in and out.

The moving rail 33 may be slidably connected to the fixing rail 32. The moving rail 33 may be formed to correspond to the guide 323. Further, the moving rail 33 may be formed in a long plate shape extending in forward and rear directions.

Upper and lower ends of the moving rail 33 may be formed to correspond to a shape of the guide 323 and may be seated in the guide 323 to be smoothly slid forward and backward. The moving rail 33 may be formed with an insertion part 333, in which a hooking ring 345 described hereinbelow may be inserted. The insertion part 333 may protrude by a predetermined length in an inner direction of the freezing chamber 12 to form a groove in which the hooking ring 345 may be inserted. In addition, a rear end of the moving rail 33 may be provided with a bracket 56, on which a drive motor 51 described hereinbelow may be fixedly mounted. The bracket 56 may be spaced by a predetermined distance in a rear direction from the insertion part 333.

In other words, the bracket 56 may be provided at a further rear side than the insertion part 333. The bracket 56 may include a plurality of bolting holes 561 to engage the driving motor 51, and the bracket 56 may be fixedly mounted on the moving rail 33 by, for example, a rivet, a bolt, or similar structure.

A pinion supporting part, to which the pinion 52 may be coupled, may also be provided at or on the moving rail 335. The pinion supporting part 335 may be formed at one side of the bracket 56 and may be spaced by a predetermined distance from the bracket 56, so that it may communicate with the driving motor 51. The pinion supporting part 335 may be formed integrally with the bracket 56. In this embodiment, the pinion supporting part 335 is provided at a rear side of the bracket 56; however, embodiments are not limited thereto. The pinion supporting part 335 may be provided with predetermined grooves, in which the pinion 52 may be inserted to be rotated.

The fixing rail 32 may be slidably formed similar to the moving rail 33. The rail guide 31 may be provided with a guide part that moves the fixing rail 32, and the fixing rail 32 may be slidably coupled to the guide part. The upper door 17 may be provided with a multi-stage drawing out structure.

The moving rail 33 may be coupled with the rail connector 34. A front end of the rail connector 34 may be curved in a direction substantially parallel with or to a rear surface of the upper door 17, so that it is coupled with the rear surface of the upper door 17. A door liner 172, which may protrude along an edge of the upper door 17, may be provided at the rear surface of the upper door 17, and the rail connector 34 may be coupled to an inner side of the door liner 172. Therefore, when the moving rail 33 slides, the upper door 17 may also slide and an upper side space of the freezing chamber 12 may be selectively opened and closed. An upper end of the rail connector 34 may be curved in an inner side direction of the freezing chamber 12, to form a seating part 341 configured to seat the supporting part 311 thereon. The seating part 341 may be seated in or on the supporting part 311 and moved, so that a weight of food stored in the receiving box 175 may be dispersed, making it possible to more stably operate the slide assembly 30.

A hooking ring 345 may be provided at one side of a lower end of the rail connector 34. The hooking ring 345 may be formed at a position corresponding to the insertion part 333, and may be formed in a hook shape, so that it may be inserted into a groove of the insertion part 333. Another side of the lower end of the rail connector 34 may be coupled to the moving rail 33 by, for example, a bolt. Therefore, when a user needs to separate the upper door 17 from the refrigerator 1, such as when passing through a narrow doorway, a bolt coupling of the rail connector 34 and the moving rail 33 may be released and both the upper door 17 and the rail connector 34 may be separated from the refrigerator by releasing the hooking ring 345 inserted into the inserting part 333.

Further, the seating part 341 may be formed with a receiving box fixing groove 347, to which the receiving box 175 may be removably fixed. The receiving box 175 may be directly inserted into the receiving box fixing groove 347 and may be maintained in the receiving box fixing groove 347 by a separate fixing member.

A gasket 177 may surround an outside of the door liner 172. The gasket 177 may be closely adhered to the main body 10 to block communicate between the inside and outside of the freezing chamber 12 when the upper door 17 is closed. The gasket 177 may completely seal the inside of the freezing chamber 12. Further, the gasket 177 may be formed of a soft material, such as silicon, rubber, or a similar material, to absorb impact when the upper door 17 is closed.

The structure of the above slide assembly 30 may be identically applied to both sides of the freezing chamber 12, so that the upper door 17 may be smoothly drawn in and out. Further, the bracket 56 may be provided to or on only one or any of moving rail(s) 33. In other words, the drive motor 51 may be coupled to only one slide assembly.

The drive motor 51, which may provide a driving force to move the moving rail 33 in forward and backward directions, may be coupled to the bracket 56. The drive motor 51 may move together with the moving rail 33 in the forward and backward directions. The drive motor 51 may be surrounded by a motor housing 511. A first rotational shaft 513*a* and a second rotational shaft 513*b* may each protrude at sides of the housing 511, as shown in FIG. 4. The first rotational shaft 513*a* may be connected to the connection part 55 described hereinbelow and the second rotational shaft 513*b* may be connected to the pinion 52. The rotational shafts 513*a* and 513*b* may be positioned on a same line. The drive motor 51 may be operated so that the rotational shafts 513*a* and 513*b* may be rotated at the same time. Further, the rotational shafts 513*a* and 513*b* may be a single shaft.

A three phase blushless DC (BLDC) motor or a single phase induction motor may be utilized as the drive motor 51. The drive motor 51 may be provided with a plurality of hall sensors (not shown) that sense rotation of the drive motor 51. For example, when the three phase blushless DC (BLDC) motor is provided as the drive motor 51, three hall sensors may be provided, and when a single phase induction motor is provided, two hall sensors may be provided.

Operation of the drive motor 51 may be controlled by a motor driver 560 described hereinbelow and may be supplied with necessary power. Detailed contents and structure thereof will be described hereinbelow.

The drive motor 51 may be a motor whose rotational shafts 513*a* and 513*b* may be rotated by an external force even when not supplied with power. Therefore, a user may input instructions to automatically draw in and out the upper door 17 and/or may manually draw in and out the upper door 17 using the handle 171.

The motor housing 511 may be provided with a flange 515 that fixes the drive motor 51 to the moving rail 33. The flange 515 may be fixed to the bracket 56 by, for example, a bolt. The flange 515 may include a plurality of bolt holes 515*a*. Further, the flange 515 may be configured so that the pinion 52 inserted on or in the second rotational shaft 513*b* may be connected to the pinion supporting part 335. In other words, the flange 515 may extend a predetermined length from the housing 511, so that when it is fixed to the bracket 56, a center of the pinion 52 is rotatably connected to the pinion supporting part 335. Therefore, when the drive motor 51 is coupled to the bracket 56, a center of the pinion supporting part 335, the center of the pinion 52, and the first rotational shaft 513*a* may be disposed on a same axis. The drive motor 51 may be fixed to the moving rail 33 by coupling the flange 515 and the bracket 56, such that the pinion supporting part 335 may be removed.

The pinion 52 may be inserted into the pinion supporting part 335, and may be formed having a size at which it may communicate with the rack 315. In other words, the pinion 52 may move along the rack 315. As the pinion 52 transfers rotational force of the drive motor 51, it may be referred to as a rotational force transferring member, and as the rack 315 guides movement of the rotational force transferring member, it may be referred to as a guide member.

The rotational shaft 513*a* may be connected to a shaft 54 through or by the connection part 55. In more detail, one side of the connection part 55 may be formed with grooves corresponding in shape to the first rotational shaft 513*a*, and another side thereof may be formed with grooves corresponding in shape to the shaft 54. One side of the connection part 55 may receive the first rotational shaft 513*a* inserted therein and the other side thereof may receive the shaft 54 inserted therein, so that rotation of the rotational shaft 513*a* may be transferred to the shaft 54. The shaft 54 may be fixed to the connection part 55 by, for example, a bolt.

The shaft 54 may traverse the freezing chamber 12, and one side thereof may be connected to the connection part 55 and another side thereof directly connected to the pinion 53. The pinion 53 may be connected to the pinion supporting part of the slide assembly on a side on which the pinion 53 is provided, such that it may be rotated. Therefore, when the rotational shafts 513*a* and 513*b* are rotated by the drive motor 51, the pinions 52 and 53 on both sides may be rotated at a same rotational speed.

The drive motor 51, the shaft 54, and the pinions 52 and 53 form a drive device that slidably moves the slide assembly 30 or the upper door 17, and may be referred to a door driving assembly. The door driving assembly may include at least the drive motor 51 and the pinion 52.

The drive motor 51 may be provided at a rear end of the moving rail 33, such that it may interfere with a rear wall surface of the freezing chamber 12, in a state in which the upper door 17 is completely closed. To prevent this, the drive motor 51 may be inclined to correspond to a shape of the rear wall of the freezing chamber 12.

Hereinafter, operation of the refrigerator 1 according to an embodiment having the above configuration will be described.

If a user inputs a drawing in or out instruction for the upper door 17 through the input device 222, power may be applied to the drive motor 51, such that the rotational shafts 513*a* and 513*b* may be rotated, for example, in a forward direction (a clockwise direction in FIG. 3). As a result, the pinions 52 and 53 may be rotated clockwise and moved along the rack 315 in a forward direction. Therefore, the moving rail 33, to which the drive motor 51 may be coupled, moves forward. At this time, the moving rail 33 may be slidably moved according to the guide of the guide part 323. The rail connector 34 may be fixed to the moving rail 33, such that the receiving box 175 and the upper door 17 move together. In other words, an upper side space of the freezing chamber 12 may be opened and a user may put food into the receiving box 175.

If the drawing in instruction is input via the input device 222, power may be applied to the drive motor 51, so that the rotational shafts 513*a* and 513*b* may be rotated in a reverse direction (a counter-clockwise direction in FIG. 2). As a result, the pinions 52 and 53 may be rotated in the counter-clockwise direction and moved along the rack 315 in a backward or rear direction. Therefore, the moving rail 33 and the upper door 17 may move in the backward direction to close the upper side space of the freezing chamber 12.

As described above, with the refrigerator 1 according to this embodiment, the receiving box 175 may be automatically drawn in and out together with the upper door 17 by operating only the input device 222 that receives input of the door drawing in and out instruction by or from a user. Thus, user convenience for, for example, older people or children may be improved. Further, as the receiving box is automatically drawn out, the receiving box may conveniently be drawn out regardless of a weight of food received in the receiving box 175.

In addition, the drive motor 51 may not be fixedly mounted on the main body 10 and may be movably provided together with the receiving box 175, such that disadvantage of reduction in volume of the inside of the refrigerator may be removed. Also, the drive motor 51 may not be fixedly mounted on the main body 10 and may be movably provided together with the receiving box 175, such that disadvantage of reduction in heat shield effect due to a reduction in a heat shield layer of the main body 10 may be removed. Moreover, as the receiving box 175 may be automatically drawn in and out continuously, the drive motor 51 may be movably provided together with the receiving box 175, making it possible to sufficiently use space between continued or multiple receiving boxes.

Further, the drive motor 51 may not be directly connected to the upper door 17, that is, to the rail connector 34 and may indirectly be connected through the moving rail 33, making it possible to conveniently attach and detach the upper door 17, if necessary. Furthermore, the guide that guides movement of the receiving box 175 may not be subjected to restrictions of the machine room and may be formed to be sufficiently long in front and rear directions of the main body, and the upper door 17 and the receiving box 175 may be sufficiently drawn out, such that a user may conveniently receive food in the inner space of the receiving box 175.

Figure 5:
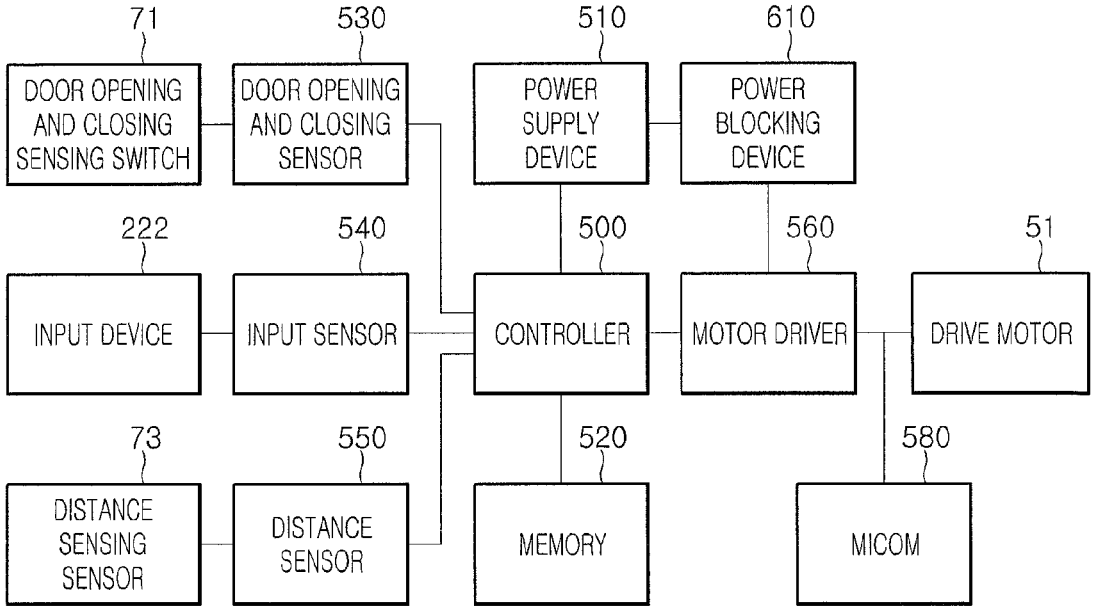
FIG. 5 is a block diagram showing a control flow of a method for controlling a refrigerator according to an embodiment.

FIG. 5 is a block diagram showing a control flow of a method for controlling a refrigerator according to an embodiment. Referring to FIG. 5, the refrigerator 1 may include a controller 500 that controls components. The controller 500 may control a power supply device 510 that supplies power to each component of the refrigerator 1, a memory that stores necessary information for operation of the refrigerator 1, a door opening and closing sensor 530 that senses opening and closing of the upper door 17, an input sensor 540 that senses the instruction of the user input from the input device 222, a distance sensor 550 that senses a distance from the upper door 17, and a motor driver 560 that controls operation of the drive motor 51 or, for example, a voltage applied to the drive motor 51.

The power supplying device 510 may also be connected to the motor driver 560 to supply power to the drive motor 51. In this case, the motor driver 560 may switch a waveform of power supplied from the power supply device 510 (for example, switching a DC voltage into an AC voltage) and may supply it to the drive motor 51. In addition, the motor driver 560 may be provided with a processor that controls, for example, the drive motor 51, a hall sensor, and similar components.

A door opening and closing sensing switch 71, which may sense the opening and closing of the door 17, may be provided on one side of the main body 10. The door opening and closing sensing switch 71 may be provided as a pressing switch device. The door opening and closing sensing switch 71 may be provided in a such way that when the upper door 17 is closed, it may be pressed, and when the upper door 17 is opened, it may protrude. A signal generated from the door opening and closing sensing switch 71 may be transmitted to the controller 500 through the door opening and closing sensor 530.

The input sensor 540 may be connected to the input device 222 and may transmit instruction of a user to the controller 500. For example, when the input device 222 is provided as a single button, it may transmit a signal informing that the button has been pressed to the controller 500, and the controller 500 may determine that the user's intention is the opening or closing of the upper door 17 according to whether the upper door 17 is opened or closed. The distance sensor 500 may be connected to a distance sensing sensor 73. The distance sensing sensor 73 may sense a distance of movement of the upper door 17 or the receiving box 175. As the distance sensing sensor 73, a sensor using infrared rays or ultrasonic wave, for example, may be used; however, embodiments are not limited thereto. That is, any known distance measuring devices may be used. For example, the distance sensing sensor 73 may be mounted on a rear wall surface of the freezing chamber 12 to sense a distance between a rear surface of the receiving box 175 and the rear wall surface of the freezing chamber 12 or may be provided on a front surface of the main body to measure a distance from the upper door 17.

Further, the motor driver 560 may calculate a rotation number of the driving motor 51 based on the signal generated from a hall sensor included in the drive motor 51, and may estimate a distance of movement of the upper door 17 and the receiving box 175 from the calculation. A distance of movement of the moving rail 33 may be calculated by multiplying $\pi$ by a diameter of the pinion 52 and the multiplying the rotation number of the drive motor 51 by it again. This will correspond to the distance of movement of the upper door 17. In this case, the hall sensor of the drive motor 51 may correspond to the distance sensing sensor 73 and the motor driver 560 may correspond to the distance sensor 550.

The motor driver 560 may receive a control signal of the controller 500 to drive the drive motor 51. The motor driver 560 may also perform a function of applying power supplied from the power supply device 510 to the drive motor 51. This may be achieved by control of the controller 500.

A power blocking device 610 may be provided on a path through which power may be supplied from the power supply device 510 to the drive motor 51. The power blocking device 610 may be provided as a device that automatically blocks power supplied to the drive motor 51 if a predetermined condition is achieved. For example, a positive temperature coefficient (PTC) may be provided as the power blocking device 610. Hereinafter, a PTC will be described as the power blocking device, as an example.

The power blocking device 610, which may be a PTC, may be provided on at least one of a first path, through which power may be supplied from the motor driver 560 to the driving motor 51, or a second path, through which power may be supplied from the power supply device 510 to the motor driver 560. When a plurality of receiving boxes, which may be automatically drawn in and out, and a plurality of drive motors are provided, the PTC may be mounted on an outlet side of the power supply device 510, making it possible to secure stability of the plurality of drive motors using a single PTC.

A PTC is a material that experiences an increase in electrical resistance when its temperature is raised. Further, the PTC may be a semiconductor device whose electric resistance is abruptly increased if temperature is raised. Furthermore, the PTC may have different resistance values depending on temperature, thereby functioning as a switch. In other words, if a condition that applied current is increased is satisfied, a resistance value may be increased to block power, thereby making it possible for the PTC to be used as the power blocking device. More specifically, the temperature may be raised depending on a flow of the current, and the resistance value of the PTC may also be raised as the temperature is raised. At this time, if the PTC is heated to a predetermined temperature or more, the resistance value may abruptly be raised so that current hardly flows onto the PTC, such that the PTC blocks power supplied to the drive motor 51. In other words, when current supplied to the drive motor 51 is abruptly increased due to an optional cause, the temperature of the PTC may be raised and the resistance value also abruptly raised accordingly, so that current does not flow onto the PTC, thereby blocking current applied to the drive motor 51.

As an example of one cause by which current supplied to the drive motor 51 may be raised, there is a case in which movement of the upper door 17 may be hindered during the moving process so as not to be movable. In this case, more current may be supplied in order to provide a rated output of the drive motor 51, so that the power supply device 510 may supply more current to the motor driver 560. In this case, the current flowing onto the PTC may be increased, making it possible to block the power supplied to the drive motor 51 as described above.

Further, a micom 580, which may be a separate controller from the controller 500, may be connected onto the path through which power may be supplied from the power supply device 510 to the drive motor 51. When the controller 500 malfunctions and continuously supplies power to the drive motor 51 under the load condition, the micom 580 may serve to forcibly block it.

Moreover, the controller 500 may sense whether load is applied to the drive motor 51. The load may mean, for example, that an abnormal current is supplied to the drive motor 51, the upper door 17 is not normally moved by, for example, an obstacle, or the drive motor 51 does not rotate the rotational shafts 513*a* and 513*b* at, for example, a command speed. In addition, various set values necessary for driving the drive motor 51 by the controller 500 may be stored in the memory 520.

Figure 6:
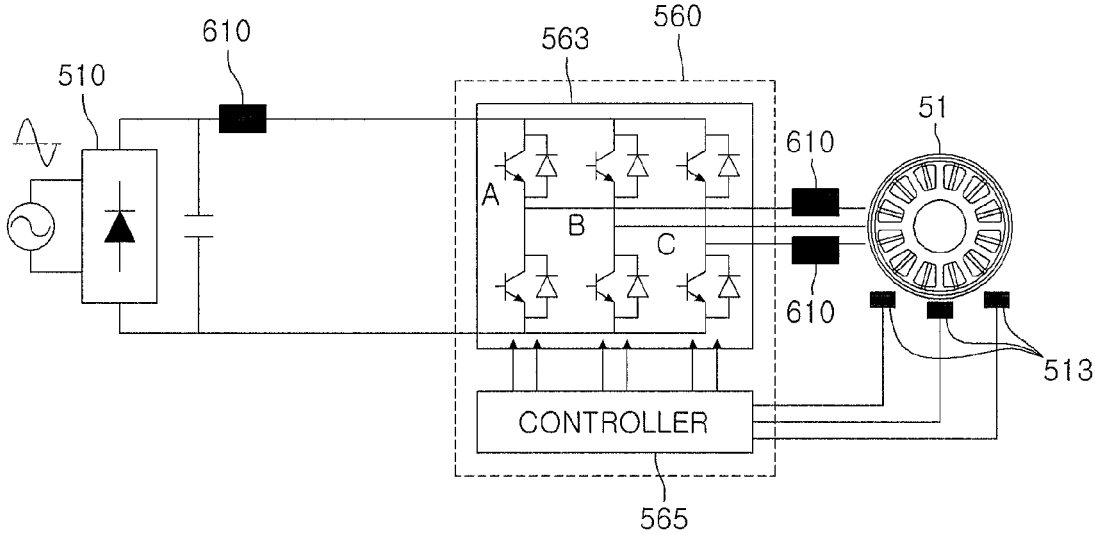
FIG. 6 is a diagram showing an example in which a positive temperature coefficient (PTC) is provided as the power blocking device when a three phase blushless DC (BLDC) motor is provided as the drive motor.

FIG. 6 is a diagram showing an example in which a positive temperature coefficient (PTC) is provided as the power blocking device when a three phase blushless DC (BLDC) motor is provided as the drive motor. Referring to FIG. 6, the three phase BLDC motor or a single phase induction motor may be provided as the drive motor 51.

The power supply device 510 may convert commercial AC voltage, which is external power of the refrigerator 1, into DC voltage to transmit it to the motor driver 560. The motor driver 560 may include an inverter 563 that switches DC voltage transmitted from the power supply device 510 to generate three phase AC voltage in a sinusoid form, and a controller 565 that controls operations of the inverter 563 and the driving motor 51.

The three phase BLDC motor may be provided as the drive motor 51, and the drive motor 51 may be provided with three hall sensors 513, making it possible to sense movement of a rotor of the drive motor 51. The hall sensors 513 may be connected to the controller 565, so that they may be used to control the drive motor 51.

The power blocking device 610, in this embodiment the PTC, may be provided on a first path, through which the switched AC voltage may be transmitted from the inverter 563 to the drive motor 51. In this case, as the drive motor 51 is the three phase BLDC motor, the PTC may be provided on at least two of the three transmission paths in order to block power.

Further, the PTC may also be provided on a second path that connects the motor driver 560 to the power supply device 510. In this case, there is an advantage that overload of the drive motor 51 may be prevented with one PTC. Even when a plurality of drive motors 51 and motor drivers 560 are provided, the PTC may be provided on or at an outlet end of the power supply device 510, making it possible to prevent overload of the plurality of drive motors with the one PTC.

Figure 7:
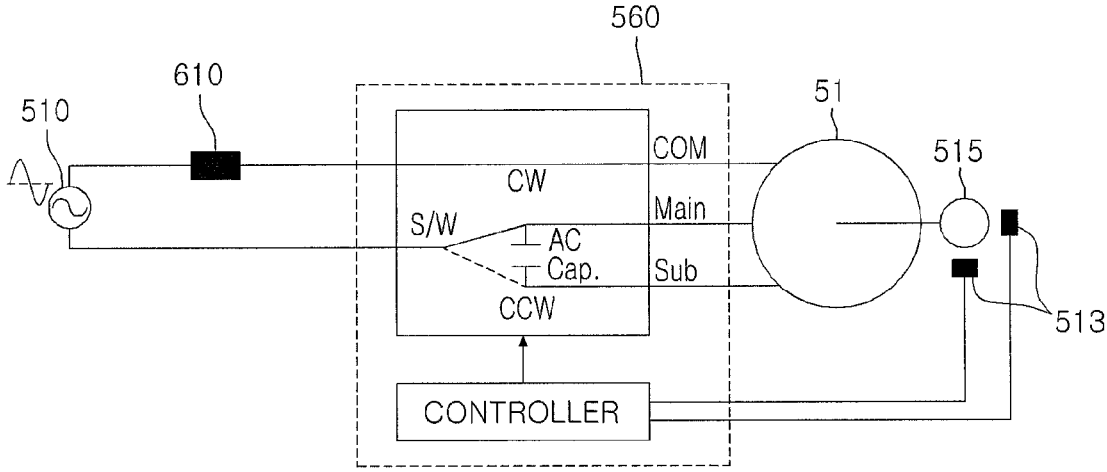
FIG. 7 is a diagram showing an example in which a PTC is provided as the power blocking device when a single phase induction motor is provided as the drive motor.

FIG. 7 is a diagram showing an example in which a PTC is provided, as the power blocking device, when a single phase induction motor is provided as the drive motor. Referring to FIG. 7, the single phase induction motor is provided as the drive motor 51. Therefore, the power supply device 510 may apply AC power and the motor driver 560 may omit the inverter. Therefore, using the single phase induction motor may reduce costs compared to the BLDC motor. In this case, the drive motor 51 may include a sensing magnet 515 and hall sensors 513 that sense rotation of the sensing magnet 515. The hall sensors 513 may be connected to the controller 565, so that they may be used in controlling the drive motor 51. In the same manner as the BLDC motor, the power blocking device 610 may be positioned on the outlet end of the power supply device 510, making it possible to prevent the overload of the drive motor 51.

Figure 8:
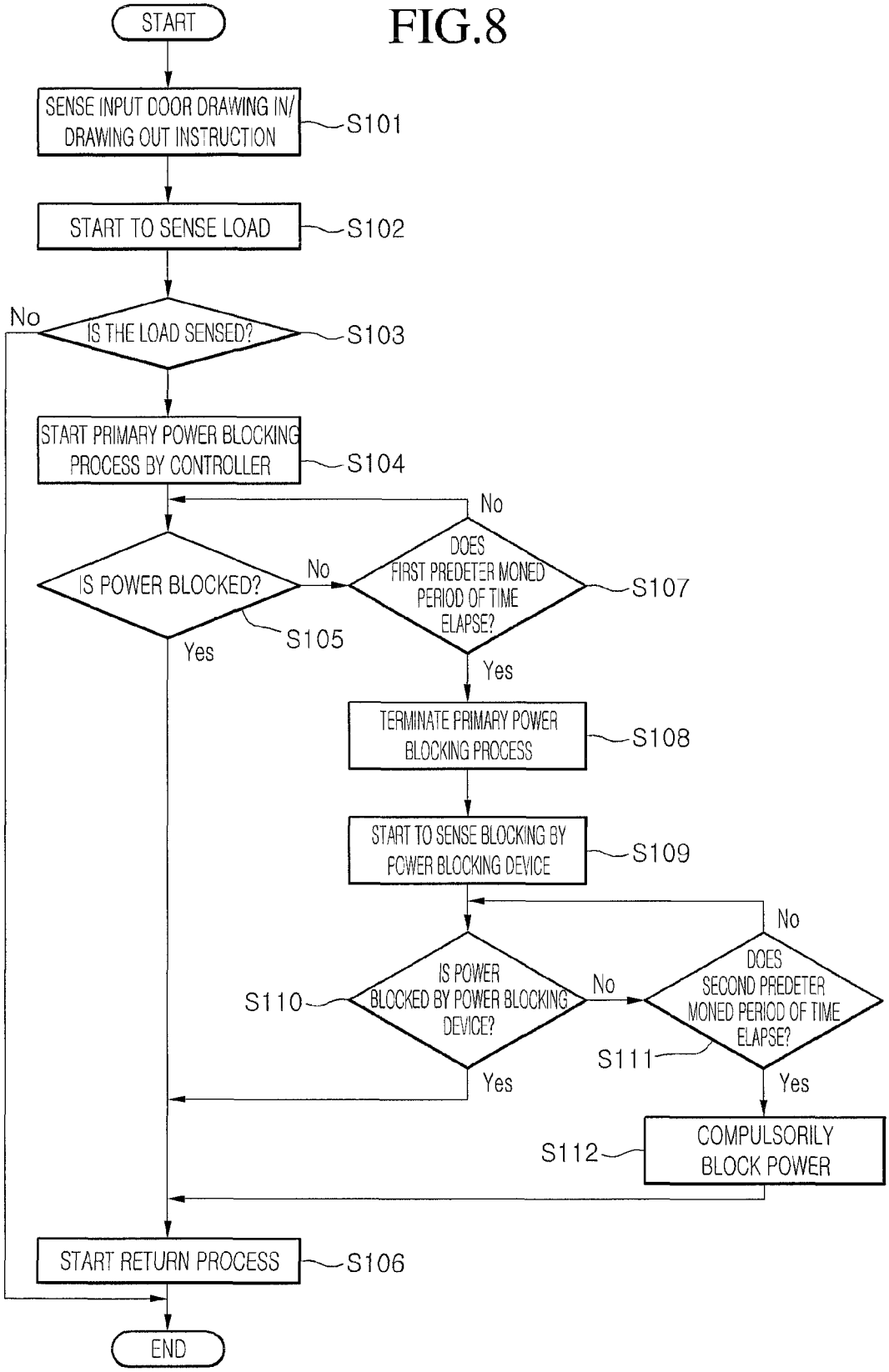
FIG. 8 is a flowchart of a method for controlling a refrigerator according to an embodiment.

FIG. 8 is a flowchart of a method for controlling a refrigerator according to an embodiment. Referring to FIG. 8, the input sensor 540 may sense whether the drawing in or drawing out instruction of the upper door 17 is input from a user, in step S101, and the controller 500 may supply power to the motor driver 560, if the instruction is input.

The controller 500 may sense whether the load is applied to the drive motor 51 during the process of drawing in and out of the upper door 17, in step S102. The sensing of the load may be performed using various methods. For example, the controller 500 may sense the load based on a distance value transmitted from the distance sensor 550. In other words, if a variation of the distance sensed by the distance sensor 550 is smaller than a set value, it may be determined that the upper door 17 is not normally moved or prevented from moving by, for example, an obstacle.

As another example, the load may also be sensed based on a signal of the hall sensors 513. The hall sensors 513 may sense rotation of a rotor of the drive motor 51 and may transmit a signal to the motor driver 550, wherein if the upper door 17 is not moved or prevented form moving by, for example, an obstacle or the rotor is rotated at an abnormal speed, the signal sensed by the hall sensors 513 may change.

As another example, the load may also be sensed by measuring a magnitude of current transmitted to the motor driver 550. If the upper door 17 is not normally moved or prevented from moving by, for example, an obstacle, the magnitude of current supplied to the drive motor 51 may increase in order to provide rated output of the drive motor 51. Therefore, by measuring the magnitude of current on a path through which current is transmitted from the power supply device 510 to the motor driver 550, whether the load is generated may be sensed. The sensing of the current may be measured between the power supply device 510 and the power blocking device 610.

The above methods are merely examples of sensing of the load; however, embodiments are not limited thereto. That is, the load may also be sensed using various methods and well-known techniques. The feature that the upper door 17 is not normally moved or prevented from moving by, for example, an obstacle is merely an example of a load; however, a load may be applied to the drive motor 51 due to various causes, such as, for example, a malfunction of the controller 500 or a malfunction of the motor driver 500.

If the load is sensed in the controller 500, in step S103, a primary power blocking process may start, in step S104, and if the load is not sensed, the upper door 17 may be normally moved so that the entire process may be terminated. In the primary power blocking process, in step S104, a duration time of the load may be determined, making it possible to block power applied to the drive motor 51. More specifically, if the load is determined to be applied to the drive motor 51 in the method as described above and such a load condition is determined to be maintained for a set or predetermined period of time, the controller 500 may block the power supplied to the drive motor 51 in order to prevent the drive motor 51 from being overheated. Further, the controller may continuously send a power blocking signal to the power supply device 500 or the motor driver 560. In other words, a primary protection of the drive motor 51 may be performed by control of the controller 500.

In a general case, the power applied to the driving motor 51 may be blocked by the primary power blocking process, in step S104. However, the power may not be blocked by the primary power blocking process, in step S104, due to unexpected causes, such as, for example, an error in transmission of current due to a low temperature environment. In this case, if the power is continuously supplied to the drive motor 51, the drive motor 51 may be overheated and go out of order.

In order to prevent this, the controller 500 may determine whether the power supplied to the drive motor 51 is blocked after the primary power blocking process, in step S104, is performed, in step S105. At this time, if the power is blocked, a return process, in step S106, of the upper door 17 may be performed. The return process, in step S106, which is a process by which the upper door 17 may be returned to its original position, may rotate the drive motor 51 in a direction reverse to a rotation direction before the load of the drive motor 51 is sensed.

The return process, in step S106, is merely an example. That is, the controller 500 may control the upper door 17 to continue further movement after being on standby in a position in which the load is applied for a predetermined period of time, and thus, not return to its original position.

If the power is determined not to be blocked, in step S105, the controller 500 may determine whether a first set or predetermined period of time has elapsed, in step S107. The first set period of time is an allowable time for blocking voltage transferred to the drive motor 51 by the controller 500. The first set period of time may be set depending on a standard of the power blocking device 610 at a time of manufacturing the product. In other words, if the power is not blocked until the primary power blocking process, in step S104, is performed and the first set period of time has elapsed, it may be determined as a problem condition in which control of the controller 500 is not normally performed.

In this case, the controller 500 may terminate the primary power blocking process, in step S108, and sense whether the power supplied to the drive motor 51 is blocked by the power blocking device 610. The power blocking of the power blocking device 610 may be the same as described above, and detailed description thereof has been omitted. Whether the power is blocked by the power blocking device 610 may be determined by measuring an amount of current flowing onto the power blocking device 610.

If it is sensed that the power is blocked by the power blocking device 610, in step S110, the return process, in step S106, may be performed and the entire process terminated. In other words, as a primary protection process by the controller 500 is not normally performed, the power blocking device 610 may serve to secondarily protect the drive motor 610. Therefore, stability of the driving assembly of the upper door 17 may be improved.

In addition, if it is determined that the power is not blocked by the power blocking device 610, the controller 500 may determine whether a second set or predetermined period of time has elapsed, in step S111. The second set period of time may be a set time rendered in forcibly blocking power in order to protect the drive motor 51, notwithstanding whether the power is blocked by the power blocking device 610. The second set period of time may be set differently depending on the standard, such as, for example, an allowable temperature of the drive motor 51. More specifically, if current is supplied for the second set period of time or more, even though load is applied to the drive motor 51, the temperature of the driving motor 51 may be raised to exceed the allowable temperature, and thus, to cause a concern that the drive motor 51 may go out or order, such that the power supplied to the drive motor 51 may be forcibly blocked, in step S112.

Step S112 may be controlled by the micom 580, rather than the controller 500. This is, when the power blocking program is not performed due to an error of the controller 500, the control of the controller 500 may not be reliable. Step S112 may be controlled by the micom 580, which may be provided separate from the controller 500, making it possible to enhance reliability of the power blocking.

The power blocking device 610 may be selected as a product having a standard that may be operated between the first set period of time and the second set period of time. Alternately, the first set period of time and the second set period of time may be controlled conforming to characteristics of the power blocking device 610 at a time of manufacture of the refrigerator 1.

Further, even if the control method is not performed as described above because the controller 500 has malfunctioned, the power supplied to the drive motor 51 may be blocked by the power blocking device 610, making it possible to secure stability of the refrigerator 1. Moreover, the power blocking may be previously performed by the controller 500 and the power blocking may also be preparatorily performed by the power blocking device 610, making it possible to more efficiently use the drawing in and out function of the upper door 17. In addition, overheat of the drive motor 51 may be prevented by the power blocking device 610, making it possible to secure stability even though the refrigerator 1 may be designed to use a drive motor based on a standard having more rapid torque and rotational speed.

Figure 9:
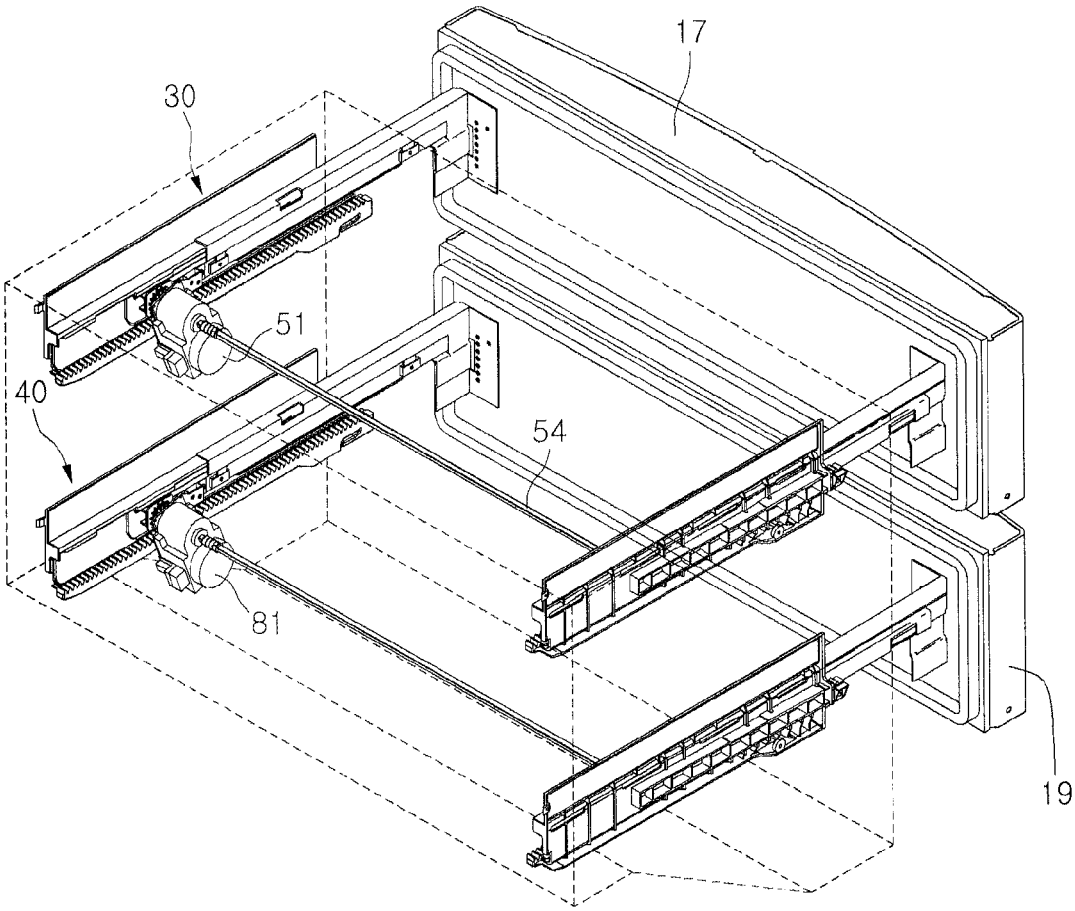
FIG. 9 is an exploded perspective view of an upper door and a lower door of a refrigerator according to another embodiment.

FIG. 9 is an exploded perspective view of an upper door and a lower door of a refrigerator according to another embodiment. Referring to FIG. 9, a refrigerator according to this embodiment may include a lower slide assembly 40 that moves the lower door 19 in forward and backward directions, as well as the upper slide assembly 30 that moves the upper door 17 in forward and backward directions.

The lower slide assembly 40 may include a rail guide, a fixing rail, a moving rail, and a rail connector similar to the upper slide assembly 30 of the embodiment of FIG. 2. In addition, a lower drive motor 81 that moves the lower door 19 in forward and backward directions may be provided at or on the moving rail of the lower slide assembly 40. A receiving box 195 (see FIG. 1), which may be detachably mounted on the rail connector of the lower slide assembly 40, may be moved in forward and backward directions along with the lower door 19. The lower door 19 may be slidably drawn in and out manually by the user and may be slidably drawn in and out automatically by the instruction of a user through the input device.

Further, a power blocking device, like a PTC, may be connected to the lower drive motor 81, and the power blocking device may block power supplied to the lower drive motor 81, if a predetermined condition is achieved. The controller 500 may control the lower driving motor 81 and the upper driving motor 51 separately.

Additional information regarding the structure and function of a drawer type refrigerator may be found in co-pending U.S. application Ser. Nos. 12/390,520, 12/390,523, 12/390,524, 12/390,527, 12/510,372, 12/345,946, 12/345,984, 12/724,558, 12/724,571, 12/724,606, and 12/724,648, which are incorporated herein by reference.

Embodiments disclosed herein provide a refrigerator capable of automatically drawing out a receiving box depending on a selection of a user and a method for controlling the same. Further, embodiments disclosed herein provide a refrigerator capable of securing a volume of an inside of the refrigerator and preventing degradation of a heat shield performance while providing a function of automatically drawing in and out a receiving box and a method for controlling the same.

Furthermore, embodiments disclosed herein provide a refrigerator capable of securing a volume of an inside of the refrigerator even when a plurality of automatically drawing in and out receiving boxes are continuously formed and a method for controlling the same. Additionally, embodiments disclosed herein provide a refrigerator capable of easily attaching and detaching a drawn in and out door together with a receiving box to the refrigerator and a method for controlling the same.

Also, embodiments disclosed herein provide a refrigerator capable of automatically drawing in and out a receiving box and then conveniently receiving food in an inner space of the receiving box and a method for controlling the same. Moreover, embodiments disclosed herein provide a refrigerator capable of preventing a motor that moves the receiving box from being overloaded and overheated when movement of the receiving box is hindered and a method for controlling the same.

Additionally, embodiments disclosed herein provide a refrigerator capable of preventing power consumption when movement of the receiving box is hindered and a method for controlling the same. Moreover, embodiments disclosed herein provide a refrigerator capable of providing improved performance and efficiency, while providing the same stability, and a method for controlling the same.

Embodiments disclosed herein provide a refrigerator that may include a main body having a storage space that stores food at a low temperature; a door that selectively opens and closes the storage space; a receiving box provided in or at a rear of the door and drawn in and out together with the door; a slide assembly provided at a side wall of the storage space so that at least a portion thereof may be drawn out to guide a forward and backward movement of the door; a driving motor mounted on the slide assembly to provide a driving force to allow the door to be slidingly drawn in and out; a power supplying unit or device that supplies power to the driving motor; a motor driver that controls the driving of the driving motor; and a power blocking unit or device installed on a path through which power is supplied from the power supplying unit to the driving motor.

Embodiments disclosed herein further provide a method for controlling a refrigerator that may include applying power to a driving motor that moves together with a door; sensing whether a load is applied to the door or the driving motor; primarily blocking power supplied to the driving motor using a control unit or controller when the load is sensed; and secondarily blocking power supplied to the driving motor using a power blocking unit or device when the power is not blocked by the primary power blocking.

With the refrigerator and the method for controlling a refrigerator according to the embodiments disclosed herein, the receiving box may be automatically drawn in and out together with the door only by the operation that the user operates an input unit inputting the door drawing in and out instructions, thereby increasing user convenience of children and older people. In addition, since the receiving box is automatically drawn out, the receiving box may conveniently be drawn out regardless of a weight of food received in the receiving box.

Further, since the driving motor for automatically drawing out the receiving box is not fixedly mounted to the main body of the refrigerator and may be moved together with the receiving box, a volume of an inside of the refrigerator may be removed. Furthermore, as the driving motor is not fixedly mounted to the main body and may be moved together with the receiving box, a heat shield effect may be reduced due to reduction in thickness of the heat shield layer of the main body. Also, when the receiving box can be automatically drawn in and out continuously, the driving motor may be movably provided together with the receiving box, making it possible to sufficiently use space between continued receiving boxes. Moreover, the driving motor may not be directly connected to components that are connected to the door, making it possible to conveniently attach and detach the door, if necessary.

Further, the guide guiding movement of the receiving box may be formed to be sufficiently long in front and rear directions of the main body to draw out the door and the receiving box, making it possible to conveniently receive food in an inner space of the receiving box. In addition, when the movement of the receiving box is hindered, the power blocking unit may be provided to block power applied to the driving motor, making it possible to prevent the driving motor from being overloaded.

Moreover, the power blocking by the power blocking unit may be controlled to be performed only under a specific condition, making it possible to more efficiently use the automatic drawn-in and out function of the receiving box. In addition, the driving motor may be prevented from being overheated by the power blocking unit, making it possible to secure stability even though a standard driving motor having rapid torque and rotational speed is used.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a storage space in which food is stored at a low temperature;

at least one door that selectively opens and closes the storage space;

a receiving box provided at a rear of the at least one door and configured to be drawn in and out together with the at least one door;

a slide assembly, at least a portion of which is configured to be drawn in and out to guide forward and backward movements of the at least one door;

at least one drive motor that provides a driving force to allow the at least one door to be slidingly drawn in and out;

a power supply device that supplies power to the at least one drive motor;

at least one motor driver that controls a driving of the at least one drive motor;

a controller that controls power supplied from the power supply device to the at least one drive motor and primarily blocks the power supplied to the at least one drive motor when an over-load is sensed;

a power blocking device installed on a path through which the power is supplied from the power supply device to the at least one drive motor, the power blocking device secondarily blocking the power supplied to the at least one drive motor when the power is not blocked by the controller; and a micom that forcibly blocks the power when the power is not blocked by the power blocking device.

2. The refrigerator according to claim 1, wherein the power blocking device comprises a positive temperature coefficient (PTC).

3. The refrigerator according to claim 1, wherein the at least one drive motor comprises a BLDG motor.

4. The refrigerator according to claim 3, wherein the power blocking device is provided on an outlet end of the power supply device.

5. The refrigerator according to claim 3, wherein the power blocking device is provided between the at least one motor driver and the at least one drive motor.

6. The refrigerator according to claim 1, wherein the power blocking device is provided on an outlet end of the power supply device.

7. The refrigerator according to claim 1, wherein the power blocking device is provided between the at least one motor driver and the at least one drive motor.

8. The refrigerator according to claim 1, wherein the slide assembly is provided at at least one sidewall of the storage space.

9. The refrigerator according to claim 1, wherein the at least one drive motor comprises a single phase induction motor.

10. The refrigerator according to claim 9, wherein the power blocking device is provided on an outlet end of the power supply device.

11. The refrigerator according to claim 1, wherein the at least one door comprises a plurality of doors, each door of the plurality of doors having a corresponding slide assembly, at least a portion of which is drawn in and out to guide a forward and backward movement of the respective door of the plurality of doors.

12. The refrigerator according to claim 11, wherein the at least one drive motor and the at least one motor driver comprise a plurality of drive motors and a plurality of motor drivers respectively, associated with the corresponding slide assembly, and wherein the plurality of motor drivers are connected to the power blocking device.

13. The refrigerator according to claim 1, wherein the at least one drive motor and the at least one motor driver comprise a plurality of drive motors and a plurality of motor drivers respectively, and wherein the plurality of motor drivers are connected to the power blocking device.

14. The refrigerator according to claim 1, wherein the at least one drive motor is mounted on the slide assembly.

15. A method for controlling a refrigerator, the method comprising:

applying power to at least one drive motor that moves together with at least one door;

sensing whether an over-load is applied to the at least one door or the at least one drive motor;

primarily blocking the power supplied to the at least one drive motor using a controller when the over-load is sensed; and secondarily blocking the power supplied to the at least one drive motor using a power blocking device when the power is not blocked by the primary power blocking;

forcibly blocking the power supplied to the at least one drive motor when the power is not blocked by the power blocking device until a predetermined period of time has expired in the secondarily blocking the power, wherein the forcibly blocking the power is controlled by a micom provided separate from the controller.

16. The method according to claim 15, wherein the power blocking device is positioned on a path through which the power is supplied from a power supply device to the at least one drive motor.

17. The method of claim 16, wherein the power blocking device is provided on an outlet of the power supply device.

18. The method of claim 16, wherein the power blocking device is provided between at least one motor driver that controls a driving of the at least one drive motor and the at least one drive motor.

19. The method according to claim 15, wherein the power blocking device comprises a positive temperature coefficient (PTC).

20. The method according to claim 15, wherein the primarily blocking the power comprises blocking the power when the over-load condition continues for a predetermined period of time.

21. The method according to claim 15, wherein a returning process by which the at least one drive motor is rotated in order to return the at least one door to an original position or to allow the at least one door to continuously move in a direction that it moves is performed, after the power is blocked.

22. The method according to claim 15, wherein the secondarily blocking the power is controlled to be performed after the primarily blocking the power is maintained for a predetermined period of time.

* * * * *